United States Patent [19]

Boeke

[11] 4,399,374

[45] Aug. 16, 1983

[54] CURRENT STABILIZER COMPRISING ENHANCEMENT FIELD-EFFECT TRANSISTORS

[75] Inventor: Wouter M. Boeke, Nijmegen, Netherlands

[73] Assignee: U.S. Philips Corporation, New York, N.Y.

[21] Appl. No.: 238,294

[22] Filed: Feb. 25, 1981

[30] Foreign Application Priority Data

Mar. 17, 1980 [NL] Netherlands ..... 8001558

[51] Int. Cl.[3] ..... G05F 1/56

[52] U.S. Cl. ..... 307/297; 323/315; 323/316; 330/257

[58] Field of Search ..... 307/297, 304; 323/315, 323/316; 330/257, 288

[56] References Cited

U.S. PATENT DOCUMENTS 4,188,588 2/1980 Dingwall ..... 330/257 X 4,300,091 11/1981 Schade, Jr. ..... 330/288 X

*Primary Examiner*—Larry N. Anagnos

*Assistant Examiner*—David R. Hudspeth

*Attorney, Agent, or Firm*—Robert T. Mayer; Bernard Franzblau

[57] ABSTRACT

A current stabilizer equipped with field-effect transistors of the enhancement type has two parallel current paths which are coupled by means of two different current coupling circuits in order to obtain a stabilizing point. At least one of the two coupling circuits comprises two field-effect transistors which are each included in one of the two current paths. One of said field-effect transistors has a gate-source voltage which is a constant fraction of the gate-source voltage of the other transistor. This is achieved by including in series with said one transistor, a third field-effect transistor with interconnected gate and drain electrodes so that the other one of said two transistors has a gate-source voltage which is twice as high as that of the said one transistor. The other current coupling circuit is of the opposite conductivity type and may be a current mirror, but it may also comprise the complementary version of the one current coupling circuit.

13 Claims, 9 Drawing Figures

CURRENT STABILIZER COMPRISING ENHANCEMENT FIELD-EFFECT TRANSISTORS

Figure 1:
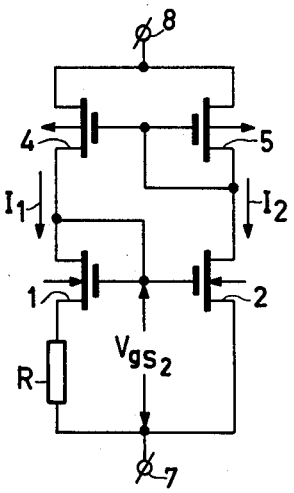
FIG.1 PRIOR ART

The invention relates to a current stabilizer comprising enhancement field-effect transistors, a first and a second parallel current path being coupled to each other with respect to current via a first and a second current-coupling circuit, which define a different relationship of the currents in the first and the second current path with one common point (value) unequal to zero at which the currents in the first and the second path stabilize themselves.

In bipolar form (see inter alia DT-OS No. 21 57 756=PHN 5337) such circuits are used on a large scale. The first current coupling circuit is then a current mirror, which defines a linear relationship between the currents in the first and the second current path and the second current coupling circuit is a current mirror with a resistor in the emitter circuit of one of the transistors of the current mirror to provide degeneration in order to obtain a non-linear relationship between the currents in the two current paths.

Current stabilizers are also frequently required in integrated circuits equipped with field-effect transistors. Using transistors of the depletion type presents no problem because a field effect transistor of the depletion type can be made to function as a current source by means of a connection between the gate electrode and the source electrode. When field effect transistors of the enhancement type are used this is not possible.

It is possible and known per se to "translate" said bipolar stabilizer into a version with field effect transistors by using field effect transistors for the transistors. However, the use of said resistor is then less attractive because the current at which the circuit stabilizes itself has a square-law relationship with the value of said resistor so that the stabilizer is very sensitive to variations in spread of the resistance value and such a resistor generally occupies much space in the integrated circuit. These problems may be precluded by replacing said resistor by a field effect transistor (of the enhancement type) operated as a resistor, but this merely results in shifting the problems because the gate of said field-effect transistor should then be biased by a stable voltage source, which again demands a voltage stabilizer which may also be subject to spread.

It is an object of the invention to provide a circuit of the type mentioned in the preamble which is subject to a minimal spread by the use of similar and similarly biased elements for stabilization. To this end the invention is characterized in that the first current coupling circuit comprises field-effect transistors of a first conductivity type and that the second current coupling circuit comprises a first field-effect transistor of a second conductivity type opposite to the first conductivity type, whose channel is included in the first current path, and a second field effect transistor of said second conductivity type, whose channel is included in the second current path, the source electrodes of the first and the second field-effect transistors being connected to a first common point and the current stabilizer comprising means for defining a fixed relationship between the gate-source voltage of the first field-effect transistor and the gate-source voltage of the second field-effect transistor.

The stabilizer in accordance with the invention does not exhibit the said problems because for stabilization only field-effect transistors without an additional bias voltage source are employed and because the stabilization is determined by process parameters which are correlated with respect to process dependence.

A first embodiment of a current stabilizer in accordance with the invention may further be characterized in that said means comprise a connection between the gate electrodes of the first and the second transistors and at least a third field-effect transistor of the second conductivity type, whose gate electrode is connected to the drain electrode and whose channel is included between the source electrode of the first transistor and the first common point.

A second embodiment of a current stabilizer in accordance with the invention may further be characterized in that said means comprise a voltage-follower amplifier, of which an input is connected to the gate electrode of the second transistor and of which an output, on which a fixed portion of the voltage on the input of said amplifier is available, is connected to the gate electrode of the first transistor.

A third embodiment of a current stabilizer in accordance with the invention may further be characterized in that the said means comprise a voltage-follower amplifier, of which an input is connected to the gate electrode of the first transistor and of which an output, on which the voltage applied to the input appears amplified by a fixed factor, is connected to the gate electrode of the second transistor.

Figure 2:
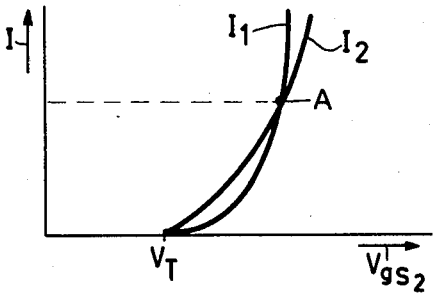
Figure 3:
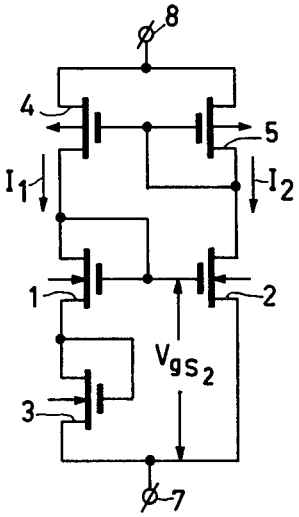
Figure 4:
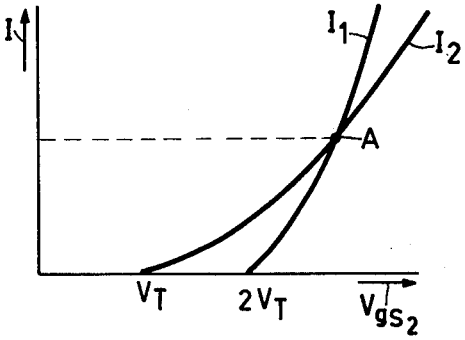
Figure 5:
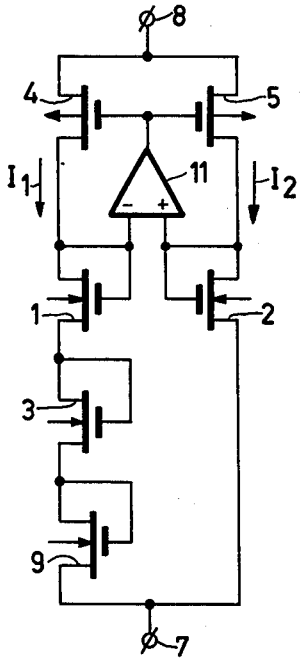
Figure 6:
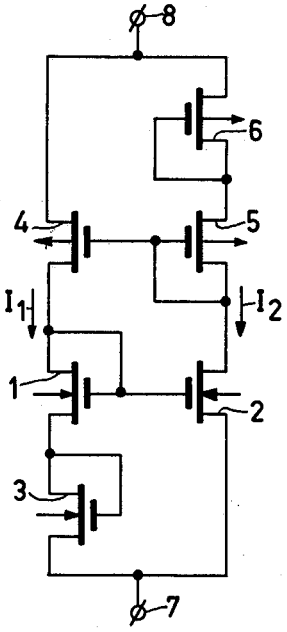
Figure 7:
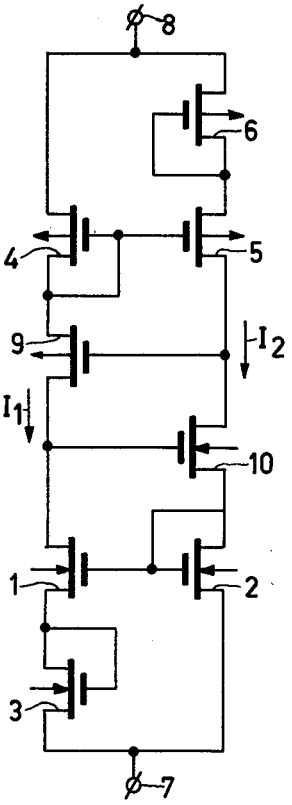
Figure 8:
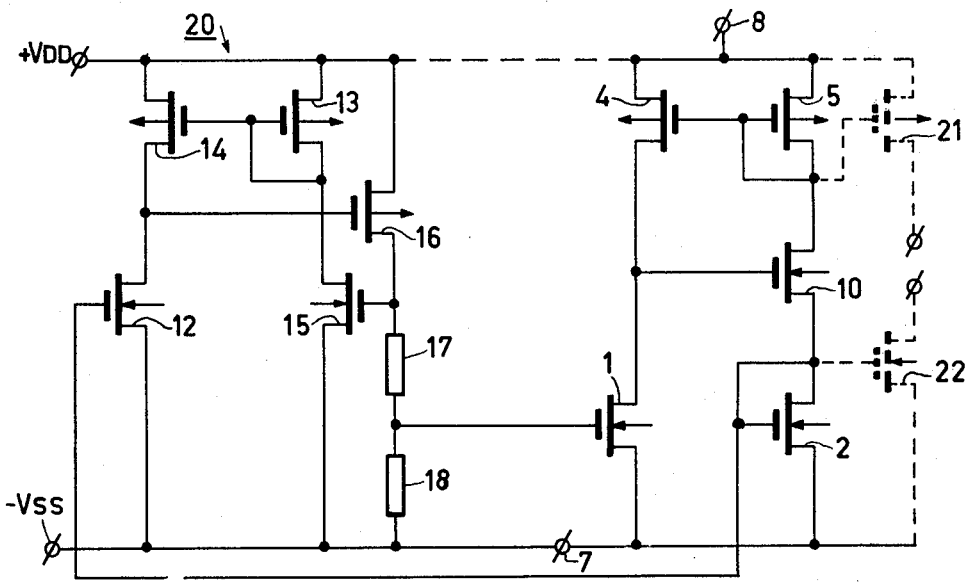
Figure 9:
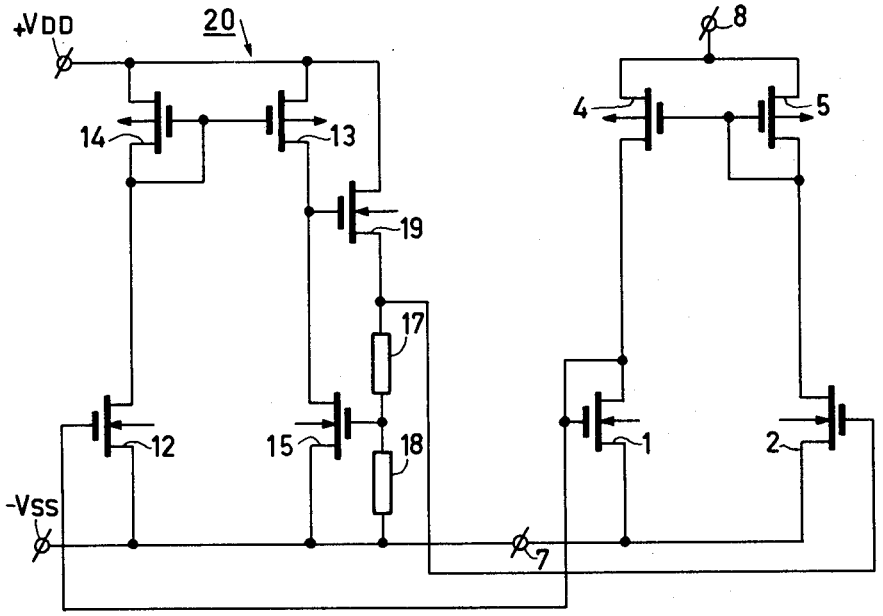

The invention will now be described in more detail with reference to the drawing, in which:

FIG. 1 represents a current stabilizer with field-effect transistor as is known in bipolar form, FIG. 2 is a diagram illustrating the operation of the circuit of FIG. 1, FIG. 3 shows a first embodiment of the stabilizer in accordance with the invention, FIG. 4 is a diagram illustrating the operation of the circuit of FIG. 3, FIG. 5 shows a second embodiment of a stabilizer in accordance with the invention, FIG. 6 is an improvement of the stabilizer of FIG. 3, FIG. 7 is an improvement of the stabilizer of FIG. 6 with respect to the stabilization impedance, FIG. 8 shows a third embodiment of a stabilizer in accordance with the invention, and FIG. 9 is a variant of the stabilizer in accordance with FIG. 8.

FIG. 1 is a version of a current stabilizer with field effect transistors which is frequently employed in bipolar form. It comprises a current mirror with p-channel transistors 4 and 5. This current mirror is coupled to a current mirror with n-channel transistors 1 and 2, which current-mirror is made non-linear by the inclusion of a resistor R in the source circuit of transistor 1.

FIG. 2 represents the currents $I_1$ and $I_2$, which flow in the current paths constituted by the series connection of the channels of transistors 1 and 4 and the series connection of the channels of the transistors 2 and 5 respectively, as a function of the gate-source voltage Vgs of transistor 2. Transistors 1 and 2 are both turned on for $Vgs=V_T$, which is the threshold voltage of the n-channel transistors 1 and 2 which are used. The current $I_1$ as a function of Vgs initially varies more gradually owing to the presence of the resistor R. By selecting the $\beta$, which is the ratio of the width and length of the channel of a field effect transistor, of transistor 1 to be greater than the $\beta$ of the transistor 2, the two currents will intersect each other at point A, where $I_1=I_2$. If the current mirror comprising transistors 4 and 5 defines this relationship $I_1=I_2$ between the currents, the circuit will stabilize in point A. If the factor $\beta$ of the transistor is equal to that of transistor 2, the curves will not intersect each other. A stabilizing point can still be obtained if the $\beta$ of transistor 5 is selected to be n times as great as that of transistor 4, so that the operating point becomes $I_2=nI_1$. A combination of the two inequalities in $\beta$ is also possible.

A drawback of the circuit arrangement of FIG. 1 is the use of the resistor R.

FIG. 3 shows an embodiment of the circuit in accordance with the invention which is identical to that of FIG. 1, but in which the resistor R has been replaced by an n-channel field-effect transistor with interconnected gate electrode and drain electrode.

FIG. 4 represents the currents $I_1$ and $I_2$ as a function of the gate-source voltage $V_{gs2}$ of transistor 2. The current $I_2$ begins to flow when $V_{gs2}>V_T$ and the current $I_1$ for $V_{gs2}>2V_T$. $I_2$ as a function of $V_{gs2}$ has been selected to have a more gradual variation by selecting said factor $\beta$ of the transistors 1 and 3 greater than that of transistor 2 (transistors 1 and 3 need not necessarily have the same channel dimensions!). The currents $I_1$ and $I_2$ then exhibit an intersection point A, which is the stabilizing point if the current mirror comprising transistors 4 and 5 imposes a non-unity ratio on the currents $I_1$ and $I_2$. In the circuit of FIG. 3, similarly to the circuit of FIG. 1, it is also possible to select the $\beta$'s of the transistors 1, 2 and 3 equal, so that the functions $I_1$ and $I_2$ will not intersect in the diagram of FIG. 4. Stabilization is then possible if transistor 5 has a $\beta$ which is n times as great as that of transistor 4, so that the circuit stabilizes at $I_1=nI_2$. Also in this case a combination of the two possibilities may be employed.

FIG. 5 represents a variant of the circuit of FIG. 3. In this circuit the gate electrodes of transistors 1 and 2 are not interconnected, but are connected to the inverting and the non-inverting inputs of a differential amplifier 11, whose output is connected to the gate electrodes of transistors 4 and 5. The gate and drain electrodes of transistor 5 are then not interconnected. The circuit of FIG. 5 further functions similarly to that of FIG. 3 because amplifier 11, by driving the gate electrodes of transistors 4 and 5, controls the currents $I_1$ and $I_2$ so that the voltages on the gate electrodes of transistors 1 and 2 are equal.

By way of illustration a further transistor 9, whose gate electrode is connected to its drain electrode, is included between transistor 3 and the common point 7 in the circuit of FIG. 5. This hardly changes the operation of the circuit. In the diagram of FIG. 4 this would result in the zero point for the curve of $I_1$ being situated at the voltage $V_{gs2}=3V_T$.

An improvement of the stabilized current with respect to the supply-voltage independence can be achieved by applying the same step to the current mirror comprising transistors 4 and 5 as to the current mirror comprising the transistors 1 and 2. This has been done in the circuit of FIG. 6, which is similar to that of FIG. 3, but in which a p-channel transistor 6, with interconnected gate and drain electrodes, is included between the source electrode of transistor 5 and the common point 8.

Many modifications and improvements to the current stabilizer in accordance with the invention are possible similar to those frequently used in the bipolar version of the circuit of FIG. 1. FIG. 7 by way of example shows the circuit of FIG. 6 in which, in order to increase the impedance of the current stabilizer, a p-channel transistor 9 and an n-channel transistor 10 respectively are cascaded with transistors 4 and 2 respectively. The connection between the gate electrode and the drain electrode of the transistors 1 and 5 is then omitted and for transistors 2 and 4 such a connection is made.

The principle of the circuits in accordance with the invention is always that transistor 1, which is included in the current path for $I_1$, receives as a gate-source voltage a certain fraction (one half for the circuits of FIGS. 3, 6 and 7 and one third for the circuit of FIG. 5) of the gate-source voltage of transistor 2 in the current path for the current $I_2$, so that $V_{gs2}-I$ characteristics (see FIG. 4) will have different zero points, if related to the Vgs of one of the two transistors, and that by dimensioning the transistors 1 and 2 and/or 4 and 5 differently a stabilizing point is obtained.

This principle in accordance with the invention, that transistor 1 receives a fraction of the gate-source voltage of transistor 2, is realized in the circuits of FIGS. 3, 5, 6 and 7 by including one or more similar transistors with interconnected drain and gate circuits in the source circuit of transistor 1, but may equally be achieved by measuring the gate-source voltage of transistor 2 and applying a fraction thereof to the gate of transistor 1, whose source electrode is connected directly to the source electrode of transistor 2 or, conversely, by measuring the gate-source voltage of transistor 1 and applying this voltage, amplified by a fixed factor, to the gate electrode of transistor 2. FIGS. 8 and 9 show examples of this.

The circuit of FIG. 8 comprises an amplifier 20 which measures the source-gate voltage of transistor 2 and applies it, attenuated by a factor k, to the gate electrode of transistor 1. In order to ensure that the drain current of transistor 1 in the present example does not flow to the output of amplifier 20, which would have been the case if its gate electrode would have been interconnected to its drain electrode, the gate electrode of the transistor 1 is not connected to the drain electrode. Instead of this, the gate electrode of transistor 2 is connected to the drain electrode of transistor 2. In order to maintain the low-ohmic current path of the combination including transistors 1 and 2 on the side of transistor 1, which is necessary for reasons of stability because in a stabilizer of the type of FIG. 1 and in accordance with the invention the input circuit of the current mirror including the transistors 4 and 5 should be constituted by the drain circuit of transistor 5 and the input circuit of the combination of transistors 1 and 2 should be constituted by the drain circuit of transistor 1, a transistor 10 has been included in conformity with the modification shown in FIG. 7.

The gate-source voltage of transistor 2 is applied to an n-channel transistor 12, which thus carries the same current or a current which is in a fixed relationship therewith. The drain current of an n-channel transistor 15 is "reflected" to the drain electrode of transistor 12 via a current mirror comprising p-channel transistors 13 and 14. The gate electrode of a p-channel transistor 16, which drives the gate of transistor 15 via a resistive divider comprising resistors 17 and 18, is connected to the drain electrode of said transistor 12. Thus, transistor 15 will be driven to have the same drain current as transistor 12, so that transistor 15 will have the same drain current as transistor 2. The gate-source voltage of transistor 15 is consequently equal to that of transistor 2. A fraction thereof, determined by a resistive divider comprising resistors 17 and 18, constitutes the gate source voltage for transistor 1 so that stabilization is effected in the same way as in the stabilizers of FIGS. 3, 5, 6 and 7. The amplifier 20 is connected between the power supply terminals $+V_{DD}$ and $-V_{SS}$.

As the source electrode of transistor 2 is connected to that of transistor 12 and also to those of the transistors 15 and 1, point 7 is also connected to the power supply terminal $-V_{SS}$. Thus, the stabilized current is available on point 7 (unless resistors 17 and 18 have such a high resistance that the source current of transistor 16 is negligible relative to the total source current of transistors 12, 15, 1 and 2, which total source current is a multiple of the source current of transistors 1 and 2). On point 8 a stabilized current is available. Point 8 may also be connected to the positive power supply terminal $+V_{DD}$. A stabilized current is then available, for example as is shown dashed in FIG. 8, by "reflecting" the current flowing in transistors 4 and 5 with a p-channel transistor 21 or by "reflecting" the current flowing in transistor 2 (or as the case may be 1) with an n-channel transistor 22. This method of coupling out the stabilized current may of course also be employed in the other embodiments.

FIG. 9 shows a variant of the circuit of FIG. 8, the voltage across the transistor 1, whose gate and source electrodes are interconnected, is measured and, amplified by a fixed factor, is applied to the gate-source electrodes of the transistor 2. Merely by way of illustration the amplifier 20 has been slightly modified. Instead of a p-channel transistor 16, an n-channel transistor 19 is used having a gate electrode connected to the drain electrodes of transistors 15 and 13. The input of the current mirror comprising transistors 13 and 14 has been transferred to transistor 14 by interconnecting its gate electrode to its source electrode. As transistor 19 drives the gate electrode of transistor 15, it is achieved that, also in this case, the gate-source voltage of transistor 15 is equal to that of transistor 12. The gate electrode of transistor 12 is connected to the gate electrode of transistor 1 so that transistor 15 has the same gate-source voltage as transistor 1. As transistor 19 drives the gate electrode of transistor 15 via a voltage divider 17, 18, the voltage on the source electrode of transistor 19 is a constant factor, determined by the ratio of resistors 17 and 18, higher than the gate-source voltage of transistor 15 and thus than that of transistor 1. This higher voltage is applied to the gate electrode of transistor 2 and the stabilizer functions similarly to that of FIG. 8.

It is to be noted that in the circuit of FIG. 1 the use of a resistor R was mentioned as a drawback. However, the use of the resistors 17 and 18 does not constitute a drawback. Said resistors hardly produce any spread because it is not the absolute values but the ratio of the values of said resistors which is of significance. Furthermore, their values may be selected independently of the desired value of the stabilized current, i.e. in such a way that they are convenient to integrate with respect to their dimensions. An additional advantage of the circuits of FIGS. 8 and 9 is that for applications where a very accurate value of the stabilized current is required, this may be achieved by trimming the resistors of the voltage divider, for example by means of a laser.

It will be obvious that the various circuits may also be inverted with respect to their conductivity types, for example by the use of n-channel transistors for the transistors 4 and 5 and p-channel transistors for the transistors 1, 2 and 3 in the circuit of FIG. 3, allowance being made for the current directions and voltage polarities.

What is claimed is:

1. A current stabilizer comprising first and second parallel current paths coupled to each other with respect to current via a first and a second current-coupling circuit which define a different relationship of the currents in the first and the second current paths, and with one common value unequal to zero at which the currents in the first and the second current path stabilize themselves, the first current coupling circuit comprising enhancement type field-effect transistors of the first channel conductivity type and the second current coupling circuit comprising a first enhancement type field-effect transistor of a second channel conductivity type opposite to the first conductivity type having a channel included in the first current path and a second enhancement type field effect transistor of said second conductivity type having a channel included in the second current path, the source electrodes of the first and the second field effect transistor being coupled to a first common point, and means for defining a fixed relationship between the gate-source voltage of the first field effect transistor and the gate-source voltage of the second field effect transistor.

2. A current stabilizer as claimed in claim 1, wherein said voltage defining means comprise a connection between the gate electrodes of the first and the second transistor and at least a third enhancement type field-effect transistor of the second conductivity type having a gate electrode connected to its drain electrode and a channel included between the source electrode of the first transistor and the first common point.

3. A current stabilizer as claimed in claim 1, characterized in that the first current coupling circuit comprises a fourth field-effect transistor of the first conductivity type having a channel included in the first current path and a fifth field-effect transistor of the first conductivity type having a channel included in the second current path, the source electrodes of the fourth and fifth transistor being coupled to a second common point, the gate electrodes being interconnected and the drain electrodes being connected to the drain electrodes of the first and the second field-effect transistor respectively.

4. A current stabilizer as claimed in claim 3 further comprising a positive feedback between the drain electrode and the gate electrode of the fifth transistor and between the drain electrode and the gate electrode of the first transistor, the gate electrodes of the first and the second transistor being interconnected.

5. A current stabilizer as claimed in claim 3, characterized in that the gate electrodes of the first and the second transistor are regeneratively coupled to the drain electrodes of said first and said second transistor, respectively and that the drain electrodes of the first and second transistor are respectively connected to the inverting and the non-inverting inputs of an amplifier having an output connected to the gate electrodes of the fourth and the fifth transistor.

6. A current stabilizer as claimed in claim 3, 4 or 5, characterized in that the channel of at least a sixth field effect transistor is included in the second current path between the source electrode of the fifth transistor and the second common point, the gate electrode of said sixth transistor being connected to the drain electrode.

7. A current stabilizer as claimed in claim 1, characterized in that said voltage defining means comprise a voltage-follower amplifier having an input connected to the gate electrode of the second transistor and an output, at which a fixed portion of the voltage on the input of said amplifier is available, connected to the gate electrode of the first transistor.

8. A current stabilizer as claimed in claim 1, characterized in that said voltage defining means comprise a voltage follower amplifier having an input connected to the gate electrode of the first transistor and an output, at which the voltage on the input appears amplified by a fixed factor, connected to the gate electrode of the second transistor.

9. A current stabilizer as claimed in claim 7, characterized in that the first current coupling circuit comprises a current mirror having an input circuit included in the drain circuit of the second transistor and an output circuit included in the drain circuit of the first transistor, the gate electrode of the second transistor being connected to the drain electrode of said second transistor, and a third transistor of the second conductivity type having a channel included between the drain electrode of the second transistor and the input circuit of the current mirror, and whose gate electrode is connected to the drain electrode of the first transistor.

10. A current stabilizer as claimed in claim 8, characterized in that the first current coupling circuit comprises a current mirror having an input circuit included in the drain circuit of the second transistor and an output circuit included in the drain circuit of the first transistor, the gate electrode of the first transistor being connected to the drain electrode of said first transistor.

11. A current stabilizer as claimed in any one of the claims 7, 8, 9 or 10, characterized in that the voltage follower amplifier comprises a fourth transistor of the second conductivity type having a source electrode connected to the first common point and whose gate electrode constitutes said input, and a fifth transistor of said second conductivity type having a source electrode connected to the first common point and whose gate electrode is coupled to said output, the drain circuits including a current mirror whose output drives the gate electrode of the fifth transistor via a sixth transistor so that the voltage on the gate electrode of the fifth transistor follows the voltage on the gate electrode of the fourth transistor with a unity gain factor.

12. A current stabilizer as claimed in claim 11, when appendent to claim 7 or 9, characterized in that between the source and the gate electrode of the fifth transistor there is included a voltage divider having a tapping which constitutes said output.

13. A current stabilizer as claimed in claim 11, when appendent to claim 8 or 10, characterized in that between said output and the source electrode of the fifth transistor there is included a voltage divider via which the sixth transistor drives the fifth transistor, the gate electrode of the fifth transistor being connected to a tapping on the voltage divider.

* * * * *

UNITED STATES PATENT AND TRADEMARK OFFICE

CERTIFICATE OF CORRECTION

PATENT NO. : 4,399,374

DATED : August 16, 1983

INVENTOR(S) : WOUTER M. BOEKE

It is certified that error appears in the above-identified patent and that said Letters Patent is hereby corrected as shown below:

In the Claims:

Claim 6, line 1, "claim" should be --claims--
line 6, change "the" to --its--

Signed and Sealed this

*Ninth* Day of *October 1984*

[SEAL]

*Attest:*

GERALD J. MOSSINGHOFF

*Attesting Officer*

*Commissioner of Patents and Trademarks*